US006655906B1

(12) United States Patent
Yuri et al.

(10) Patent No.: US 6,655,906 B1
(45) Date of Patent: Dec. 2, 2003

(54) AXIAL COMPRESSOR AND GAS BLEEDING METHOD TO THRUST BALANCE DISK THEREOF

(75) Inventors: Masanori Yuri, Takasago (JP); Vincent Laurello, Miami, FL (US)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/156,887

(22) Filed: May 30, 2002

(51) Int. Cl.[7] ..... F01D 3/02
(52) U.S. Cl. ..... 415/1; 415/104
(58) Field of Search ..... 415/104, 144, 415/207, 211.2, 1

(56) References Cited

U.S. PATENT DOCUMENTS 2,530,477 A * 11/1950 Ostmar ..... 415/104
2,647,684 A * 8/1953 Lombard ..... 417/365
2,746,671 A * 5/1956 Newcomb ..... 415/115
5,402,636 A * 4/1995 Mize et al. ..... 60/806
6,065,282 A 5/2000 Fukue et al.

FOREIGN PATENT DOCUMENTS

JP 2000-356139 12/2000
JP 3165611 3/2001

* cited by examiner

*Primary Examiner*—Ninh H. Nguyen
(74) *Attorney, Agent, or Firm*—Oblon, Spivak, McClelland, Maier & Neustadt, P.C.

(57) ABSTRACT

In order to provide an axial compressor, and a gas bleeding method to the thrust balance disks thereof, which are capable of preventing reduction of the mechanical strength of the thrust balance disks due to excessive heating up by bleed gas, a portion of the fuel gas F, after having passed through the diffuser, is conducted to the thrust balance disks as the bleed gas flow c.

6 Claims, 4 Drawing Sheets

AXIAL COMPRESSOR AND GAS BLEEDING METHOD TO THRUST BALANCE DISK THEREOF

BACKGROUND OF THE INVENTION

1. Field of the Invention

The present invention relates to an axial compressor such as, for example, a fuel gas compressor or the like, and to a gas bleeding method to a thrust balance disk of such an axial compressor. The present invention particularly relates to an axial compressor which is capable of preventing damage or failure due to excessive rise in the temperature of the thrust balance disk.

2. Description of the Related Art

An example of a prior art type axial compressor will be explained in the following with reference to the fuel gas compressor shown in FIG. 5. It should be noted that this figure is a cross section showing a portion of this compressor which includes an portion of a compression section 1 at its extreme downstream position. As shown in this figure, in the compression section 1 of this fuel gas compressor, a plurality of stationary blades 3 which are fixed within casing tubes 2*a* on the side of a casing 2 are provided, and a plurality of moving blades 5 which are fitted coaxially around the periphery of the rotor disks 4, and these stationary blades 3 and moving blades 5 are arranged alternately along the rotational axis direction of the rotor disks 4, while being structured so as to pressurize a flow f1 of fuel gas and to expel it in the direction shown by the arrows, due to the rotation of these rotor disks 4.

At this time, a thrust force due to the reaction force which accompanies this pressurized expulsion of the fuel gas flow f1 acts upon the rotor disks 4, and the rotating body which includes these rotor disks 4 tends to be driven in the direction opposite to the flow direction of the fuel gas f1 (in the leftwards direction as seen in the figure). Since an undesirably large sized bearing would be required if it were attempted to support this large thrust force only via a bearing, accordingly, in order to avoid this, a plurality of thrust balance disks are provided coaxially with the rotor disks 4. A portion of the fuel gas flow f1 which has been compressed by the compression section 1 is taken in as a bleed gas flow f2, and thereby these thrust balance disks 6 generate a counter thrust force which opposes the said thrust force, so that it becomes possible to reduce said thrust force.

Another casing ring 2*b* which is fitted to the interior of the casing 2 is provided at the peripheries of these thrust balance disks, and a plurality of labyrinth seals 7 are provided against the inner circumferential surface of this casing ring 2*b*, so as to reduce the amount of bleed gas f2 which leaks past. Upon the upstream side of the casing ring 2*b* (its left side in the drawing) there is formed a partition wall 2*b*1 which separates the fuel gas flow f1 which is the main flow and the bleed gas f2, and a gas bleed flow conduit 8 is formed inside this partition wall 2*b*1 against its inner circumferential surface, while a diffuser 9 is formed against its outer circumferential surface.

The diffuser 9 is a flow conduit whose cross section area becomes greater from its upstream side to its downstream side, and thereby as the fuel gas flow f1 passes down from the compression section 1 in which speed is reduced and its pressure is recovered. The fuel gas flow f1 which exits from this diffuser 9 is discharged towards the outside of the casing 2.

On the other hand, the bleed gas f2 which flows within the bleed gas flow conduit 8 reaches the thrust balance disks 6 and presses upon these thrust balance disks 6 and the rotor disks 4 in the rightwards direction in the figure so as to exert a counter thrust force upon them. Moreover, this bleed gas flow f2 acts as a seal gas flow between the outer peripheries of the thrust balance disks 6 and the labyrinth seals 7, and then is recovered.

However, the conventional compressor described above has problems described below.

That is, although it is essential for the thrust balance disks 6 to maintain sufficient mechanical strength since they are required to receive the bleed gas flow f2 and to generate the counter thrust force, since the bleed gas flow f2 is heated up to a high temperature due to windage loss when passing down the bleed gas flow conduit 8 and due to windage loss when passing the labyrinth seals 7, therefore there is the problem that there is a danger of the thrust balance disks 6 being heated up to excessively high temperatures, so that deterioration of their mechanical strength may occur.

The present invention has been made in consideration of the above problems, and objective is to provide an axial compressor, and a method for supplying bleed gas towards a thrust balance disk thereof, which are capable of preventing reduction of the mechanical strength of the thrust balance disk due to excessive temperature increase caused by such gas bleeding.

The present invention employs the following structure to solve the above problems.

That is, according to a first aspect of the present invention, an axial compressor comprises a compression section which compresses gas to be compressed, a diffuser which reduces the speed of the compressed gas from the compression section and subjects it to pressure recovery, a thrust balance disk which receives a portion of the compressed gas as bleed gas after it has passed through the compression section and which generates a counter thrust force which opposes thrust force which the thrust balance disk experiences as reaction force due to the compression section supplying the compressed gas under pressure, and a bleed gas flow conduit which conducts a portion of the compressed gas after it has passed through the diffuser to the thrust balance disk as the bleed gas.

According to the axial compressor according to the first aspect as above, it becomes possible to cool the thrust balance disk efficiently with the bleed gas. That is, since in the prior art, the structure was such that a portion of the gas to be compressed which had a non uniform temperature distribution was supplied to the thrust balance disk directly after exiting the compression section, accordingly the bleed gas suffered an undesirable temperature rise due to windage loss before arriving at the thrust balance disk, and there was a danger of increasing the temperature of the thrust balance disk. In contrast, by the present invention, since the bleed gas which is taken from the exit of the diffuser has a uniform temperature distribution since it has been sufficiently mixed in the diffuser, and further, the bleed gas is free from any windage loss as in the prior art, accordingly it becomes possible to supply the bleed gas to the thrust balance disk at a comparatively lower temperature than in the prior art.

Moreover, the axial compressor described in a second aspect of the present invention is characterized in that the bleed gas is supplied to the thrust balance disk so as to flow in a circumferential direction which is the same as the direction in which the thrust balance disk rotates.

In a conventional compressor as described above, when the bleed gas is directly supplied at a slow relative velocity with respect to the thrust balance disk which is rotating at a high velocity, there is a danger of excessive increase of temperature of the thrust disk due to rise in the temperature of the bleed gas caused by windage loss. In contrast, with the axial compressor described in the second aspect as above, it becomes possible to keep the relative velocity difference between the bleed gas and the thrust balance disk low, since the bleed gas is supplied so as to follow the thrust balance disk in the same circumferential direction as its direction of rotation. At this time the temperature of the bleed gas which is experienced by the thrust balance disk (i.e. which impinges thereupon) is only its relatively low static temperature which is the result of subtracting its dynamic temperature from its total temperature, and accordingly it becomes possible to cool the thrust balance disk effectively. Furthermore, it becomes possible to reduce the drive power which is required for driving the compression section, due to the impact force of the bleed gas in the same circumferential direction as the direction of rotation of the thrust balance disk.

Moreover, the axial compressor described according to a third aspect of the present invention is characterized in that the bleed gas is supplied to the thrust balance disk via a TOBI nozzle (Tangential OnBoard Injection Nozzle). According to the axial compressor described in claim 3 as above, it becomes possible to supply the bleed gas to the thrust balance disk while accurately following its motion.

According to a fourth aspect of the present invention, a gas bleeding method to a thrust balance disk of an axial compressor comprises a compression section which compresses gas to be compressed, a diffuser which reduces the speed of the compressed gas from the compression section and subjects it to pressure recovery, and the thrust balance disk which receives a portion of the compressed gas as bleed gas after it has passed through the compression section and which generates a counter thrust force which opposes thrust force which the thrust balance disk experiences as reaction force due to the compression section supplying the compressed gas under pressure, wherein a portion of the compressed gas after it has passed through the diffuser, is conducted to the thrust balance disk.

According to the gas bleeding method to a thrust balance disk of an axial compressor in the fourth aspect of the present invention, just as in the case of the first aspect as above, it becomes possible to cool the thrust balance disk by the bleed gas in an efficient manner.

Moreover, the gas bleeding method to a thrust balance disk of an axial compressor according to a fifth aspect of the present invention is characterized in that the bleed gas is supplied to the thrust balance disk so as to flow in a circumferential direction which is the same as the direction in which the thrust balance disk rotates.

According to the gas bleeding method to a thrust balance disk of an axial compressor described in the fifth aspect, just as in the case of the second aspect as above, it becomes possible to cool the thrust balance disk efficiently, also it becomes possible to reduce the amount of drive power which is required for driving the compression section.

The gas bleeding method to a thrust balance disk of an axial compressor according to a sixth aspect of the present invention is characterized in that the bleed gas is supplied to the thrust balance disk via a TOBI nozzle.

According to the gas bleeding method to a thrust balance disk of an axial compressor described in the sixth aspect, just as in the case of the third aspect as above, it becomes possible to supply the bleed gas to the thrust balance disk while accurately following its motion.

DESCRIPTION OF THE PREFERRED EMBODIMENTS

Figure 1:
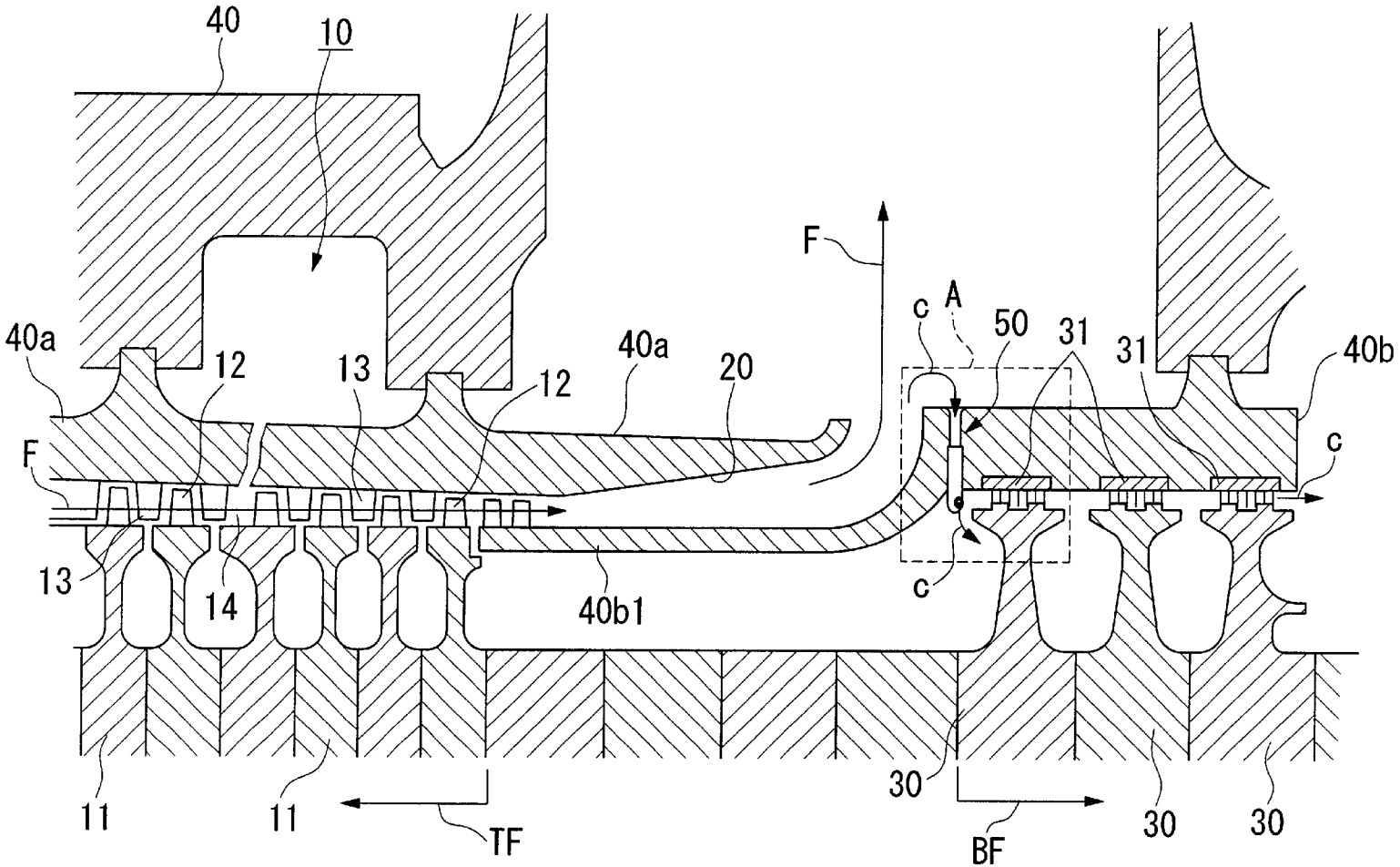
FIG. 1 is a cross section of an essential portion of a preferred embodiment of the axial compressor according to the present invention, including a portion of a compression section thereof which is at its furthest downstream position, as seen in a cross section plane containing the rotational axis thereof.
Figure 2:
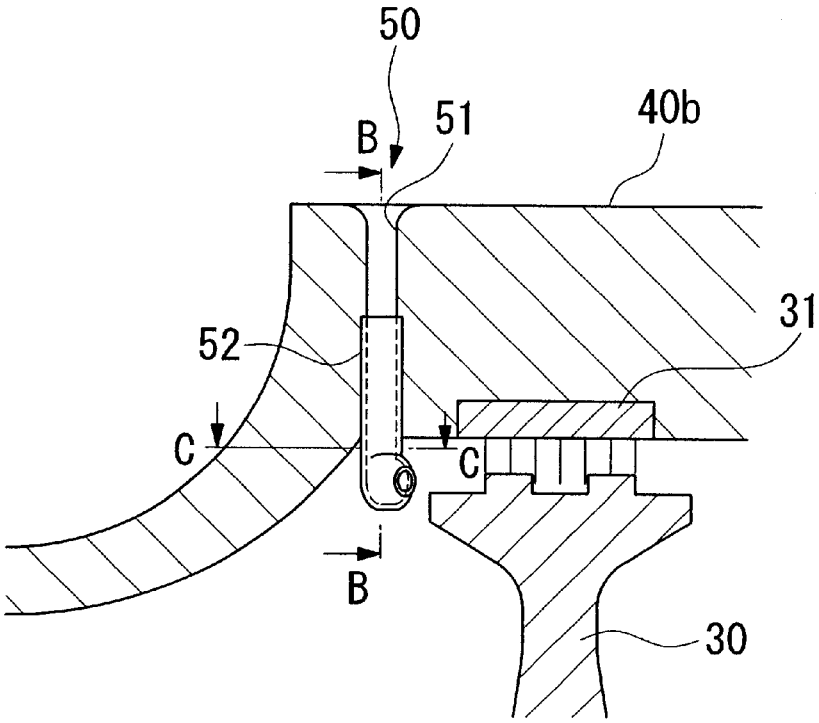
FIG. 2 is a magnified sectional view of a portion A of FIG. 1, showing a portion of this same essential portion of the axial compressor.
Figure 3:
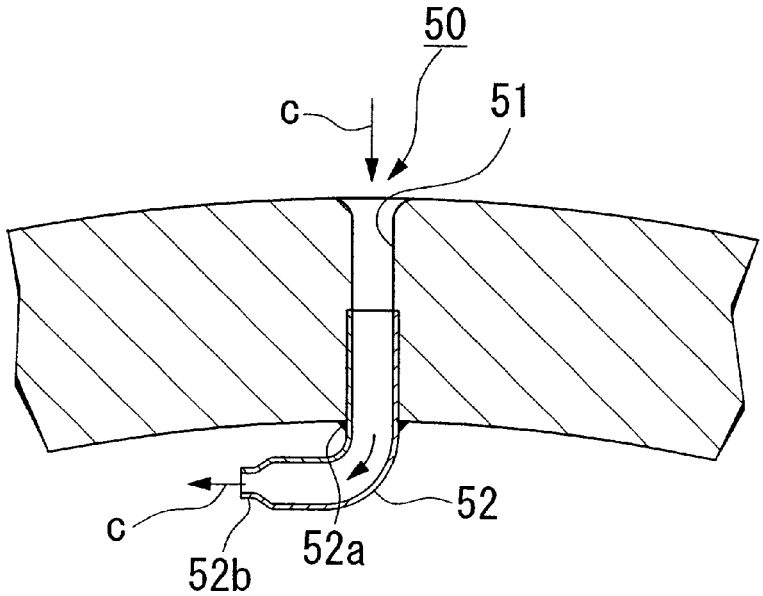
FIG. 3 is a sectional view of the same portion of the axial compressor shown in FIG. 2, taken in a sectional plane shown by the arrows B—B in FIG. 2.
Figure 4:
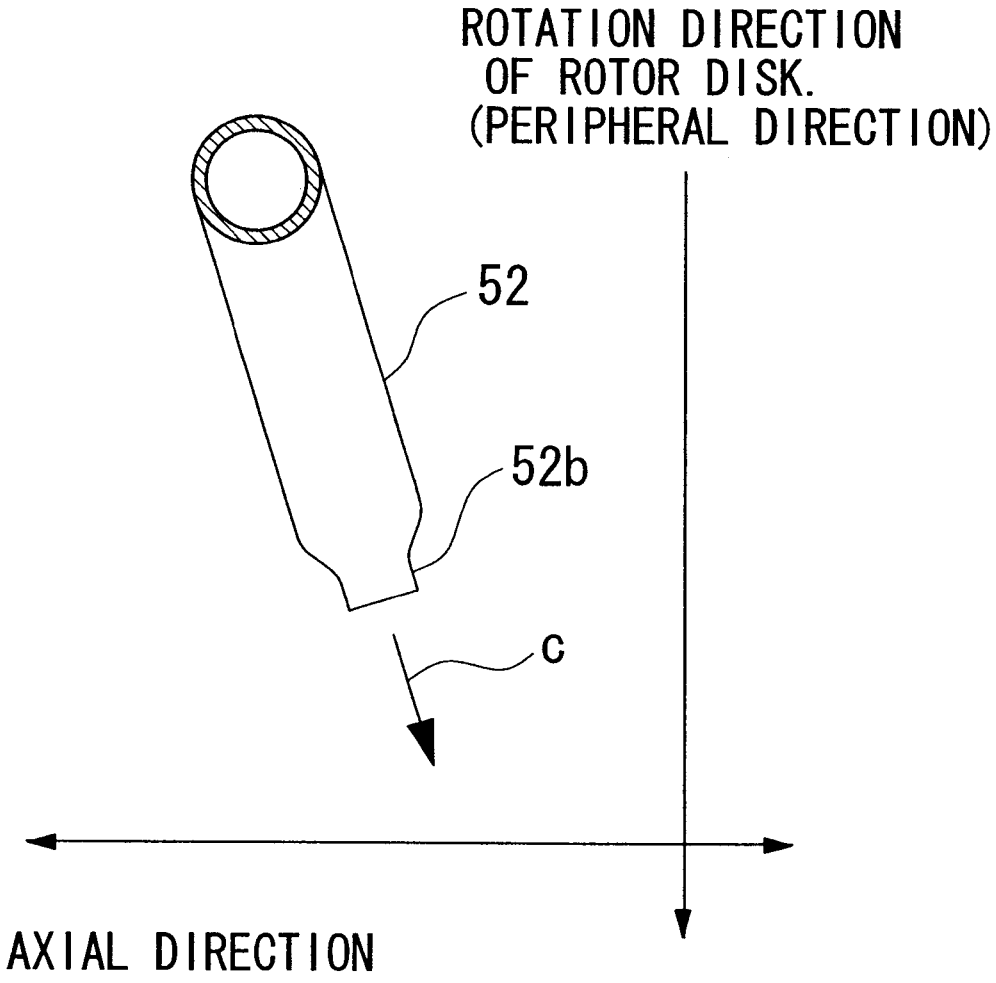
FIG. 4 is a cross section of the same portion of the axial compressor shown in FIG. 2, taken in a sectional plane shown by the arrows C—C in FIG. 2.
Figure 5:
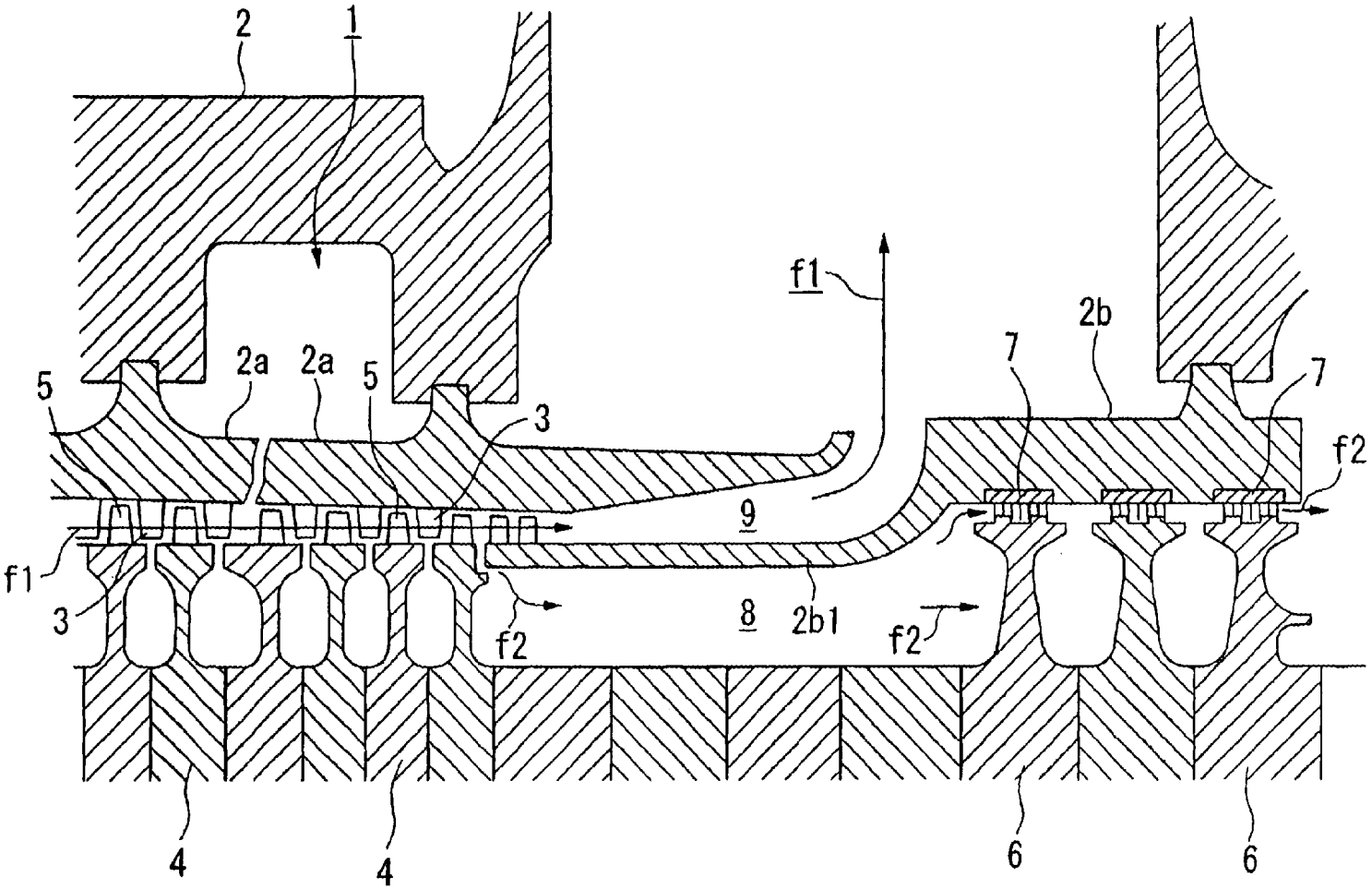
FIG. 5 PRIOR ART
FIG. 5 is a cross section of an essential portion of an example of a prior art axial compressor, including a portion of a compression section thereof which is at its furthest downstream position, as seen in a cross sectional plane containing the rotational axis thereof.

Although a preferred embodiment of the axial compressor and of the method for supplying bleed gas to the thrust balance disk thereof will be described in the following with reference to the figures, of course the present invention is not to be considered as being limited to these preferred embodiments. Here, FIG. 1 is a cross section of an essential portion of a preferred embodiment of the axial compressor according to the present invention including a portion of a compression section thereof which is at its furthest downstream position, as seen in a cross sectional plane containing the rotational axis thereof. Furthermore, FIG. 2 is a magnified sectional view of a portion A of FIG. 1, showing a portion of this same essential portion of the axial compressor. FIG. 3 is a cross section of the same portion of the axial compressor shown in FIG. 2, taken in a sectional plane shown by the arrows B—B in FIG. 2. FIG. 4 is a sectional view of the same portion of the axial compressor shown in FIG. 2, taken in a sectional plane shown by the arrows C—C in FIG. 2. It should be noted that in the explanation of these preferred embodiments, by way of example, it will be supposed that the axial compressor according to the present invention is a fuel gas compressor which compresses and expels fuel gas.

The fuel gas compressor according to this preferred embodiment of the present invention shown in FIG. 1 comprises a compression section 10 which compresses fuel gas F (gas to be compressed), a diffuser 20 which reduces the speed of the fuel gas from this compression section 10 and recovers the pressure thereof, a plurality of thrust balance disk 30 which receive a portion of the bleed gas flow c of fuel gas F after it has passed through the compression section 10 and which generate a counter thrust force BF opposed to the thrust force TF which is received by the compression section 10 as reaction due to the compression and expulsion of fuel gas F, and a casing 4 which houses these elements in its interior.

Moreover, in the following explanation, the upstream side with respect to the flow direction of the fuel gas F (the left side of the drawing paper in FIG. 1) will be referred to as the "upstream side", while conversely the downstream side with respect to the flow direction of the fuel gas F (the right side of the drawing paper in FIG. 1) will be referred to as the "downstream side". Furthermore, the direction of the rotational axis of a compression section 10 and of thrust balance disks 30 (the left to right direction upon the FIG. 1 drawing paper) will be referred to as the "axial direction".

The compression section 10 there are comprised a plurality of rotor disks 11, a plurality of moving blades 12 which are coaxially fitted to the periphery of the rotor disks 11, and a plurality of stationary blades 13 which are fixed inside casing rings 40*a* on the side of the casing 40, and these stationary blades 12 and moving blades 13 are arranged alternately along the rotational axis of the rotor disks 11, the fuel gas F is compressed and expelled in the direction shown by the arrows due to the rotation of the rotor disks 11.

The shape of a compression flow conduit 14 which is defined between the outer peripheries of the rotor disks 11 and the inner circumferential surfaces of the casing rings 40*a* is such as to narrow down from its upstream side towards its downstream side. The stationary blades 13 are respectively fixed to the inner peripheral surfaces of the casing rings 40*a* and are lined up along the circumferential direction, taking the axis thereof as a center, and moreover are arranged to alternate with the moving blades 12, as seen in the axial direction.

Due to the rotation of the rotor disks 11 and because of the rotation of the moving blades 12 as well, the fuel gas F in the compression flow conduit 14 is compressed and set into flow (the main flow) in the downstream direction.

The diffuser 20 is a flow conduit whose flow conduit cross section area increases from its upstream side towards its downstream side and it slows down the speed of the fuel gas F which has been compressed and expelled from the compression section 10 while recovering the pressure thereof. The fuel gas F which has exited from this diffuser 20 is discharged towards the exterior of the casing 40.

The thrust balance disks 30 generate a counter thrust force BF to oppose the thrust force TF by taking in a portion of the fuel gas F which has been compressed by the compression section 10 as bleed gas, and thus it becomes possible to reduce the thrust force TF. Another casing ring (which is a tubular member disposed at the downstream side of the compression section 10, and which is denoted by the reference symbol 40*b* since it is provided separately from the casing rings 40*a*) is provided at the peripheries of these thrust balance disks 30 and is fixed to the interior of the casing 40, and a plurality of labyrinth seals 31 are provided between said thrust balance disks 30 and said casing ring 40*b*, so as to reduce the amount of leakage of bleed gas c. A partition wall 40*b*1 is formed on the upstream side (the left side in the figure) of the casing ring 40*b* so as to partition between the main flow of fuel gas F and the bleed gas flow c, and the diffuser 20 is formed between the outer peripheral surface of this partition wall 40*b*1 and the inner peripheral surface of the casing ring 40*a*.

In the fuel gas compressor according to this preferred embodiment of the present invention is characterized in that a portion of the fuel gas F, after it has passed through the diffuser 20, is supplied to gas bleed flow conduits 50 which conduct it to the thrust balance disks 30 as said bleed gas c.

Because of the provision of these bleed gas flow conduits 50, it becomes possible efficiently to cool the thrust balance disks 30 by this bleed gas c. That is, conventionally, since the structure is such that, directly after having passed through the compression section 1, a portion of the fuel gas f1 which has an unequal temperature distribution in the radial direction with respect to the axial direction as a center is conducted to the thrust balance disks 6 directly without passing through the diffuser 9, accordingly the bleed gas c undesirably suffers a temperature rise due to windage loss before it arrives at the thrust balance disks 6, and therefore there is a danger of increasing the temperature of these thrust balance disks 6. By contrast to this, in the preferred embodiment of the present invention, since the structure is such that the bleed gas c is taken out after having exited from the diffuser 20 with an equal temperature distribution due to being sufficiently mixed via the diffuser 20, and moreover without having suffered any windage loss such as occurred in the prior art, accordingly it is possible to supply this bleed gas c to the thrust disks 30 at a comparatively lower temperature than in the prior art.

Each of these bleed gas flow conduits 50 is formed from a hole 51 which is formed in the casing ring 40*b* and a TOBI nozzle 52 which is fixed in this perforation 51, as shown in FIG. 2. It should be noted that these gas bleed flow conduits 50 are arranged at mutually equally spaced angular intervals around the circumferential direction, taking the axis of the thrust balance disks 30 as a center.

The holes 51 are formed along the radial direction with respect to said axis as a center, and their entrance portions are subjected to arle processing in order to make it easier for the bleed gas c to be taken in. And a TOBI nozzle 52 is fixed by welding into the outlet end of each of these holes 51. As shown in FIG. 3, each of the TOBI nozzles 52 is a roughly "J" shaped tube member, and its discharge aperture 52*b*, which is at its opposite end from the welded portion 52*a* by which it is fixed, constitutes a flow conduit which is narrowed down so as to be convergent. Due to this, the bleed gas c which enters from the hole 51 flows through the main body of the TOBI nozzle which has a constant cross sectional area, then changes direction around approximately a right angle towards the discharge aperture 52*b*, then increases its speed as the cross sectional area of the flow conduit narrows down at the discharge aperture 52*b*, and finally is discharged to the exterior of the TOBI nozzle 52.

Furthermore, as shown in FIGS. 3 and 4, the direction of the discharge aperture 52*b* of each TOBI nozzle 52 is arranged so that it points to expel the flow of bleed gas c in the same circumferential direction as the direction of rotation of the thrust balance disks 30. By arranging for the method for supplying bleed gas to the thrust balance disks 30 in this manner, it is possible to keep the relative speed difference between the bleed gas flow c and the thrust balance disks 30 low. Since the temperature of the bleed gas which is experienced (i.e., whose impact is received) by the thrust balance disks 30 is its static temperature, which is the result of subtracting its dynamic temperature from its total temperature, therefore it becomes possible to cool the thrust balance disks 30 in an efficient manner.

Yet further, it becomes possible to reduce the power which is required for driving the compression section 10, since the thrust balance disks 30 receive the impact force of the bleed gas c which flows in the same rotational direction as their direction of rotation. In other words since, with respect to the thrust balance disks 30 which are rotating, the bleed gas flow c is sprayed so as to assist their rotation, accordingly it becomes possible to manage with a lower level of drive power which is required for rotationally driving the rotor disks 11 which are set coaxially with these thrust balance disks 30.

The sequence of flow of the bleed gas c in the fuel compressor according to the preferred embodiment of the present invention with the structure as described above will now be explained in the following.

First, the rotating member which comprises the rotor disks 11 and the thrust balance disks 30 is rotated around its axis, and the fuel gas f in the compression flow conduit 14 is driven into the diffuser 20 while being subjected to compression action. At this time the fuel gas F subjects the aforesaid rotating member to a thrust force T which pushes it towards the upstream side.

The fuel gas F which has been discharged from the diffuser 20 is discharged in this state to the exterior of the casing 40, and at this point a portion thereof is introduced into the bleed gas flow conduit 50 as the bleed gas flow c. The directions of the trajectories of the flows of the bleed gas c through the bleed gas flow conduit 50 are corrected by the TOBI nozzles 52, and these bleed gas flows are then sprayed in towards the thrust balance disks 30 so as to follow their rotation. While the bleed gas c functions to cool the thrust balance disks 30 and to assist their rotation, it also serves as a flow of seal gas which flows between the outer peripheries of the thrust balance disks 30 and the labyrinth seal 31, and is then recovered.

The fuel compressor and the method for supplying bleed gas towards the thrust balance disks 30 thereof described above provide the following beneficial results. That is, the fuel compressor of this preferred embodiment of the present invention employs a structure and a method with which a portion of the flow F of fuel gas is conducted to the thrust balance disks 30 as bleed gas c after passing through the diffuser 20. Due to this the fuel gas flow F, which is at a comparatively low temperature after having passed through the diffuser 20, is supplied to the thrust balance disks 30 as bleed gas c, accordingly it is possible to cool the thrust balance disks 30 efficiently, and it becomes possible to prevent deterioration of the mechanical strength of the thrust balance disks 30 due to excessive heating up from the bleed gas c.

Furthermore, the fuel compressor of this preferred embodiment of the present invention utilizes a structure and a method with which the bleed gas c flows in a circumferential direction which is the same as the rotational direction of the thrust balance disks 30. Due to this it becomes possible to cool the thrust balance disks 30 more efficiently, since, with regard to the temperature of the bleed gas which impinges upon the thrust balance disks 30, the bleed gas c is only at its static temperature which is the result of subtracting its dynamic temperature from its total temperature. Yet further, it also becomes possible to perform drive power recovery, since it is possible to reduce the drive power which is required for driving the compression section 10, due to the impacting force of the bleed gas c which flows in the same circumferential direction as the rotational direction of the thrust balance disks 30.

Although, in the explanation of the preferred embodiments of the device and method of the present invention detailed above, the present invention has been described by way of example in terms of its application to a fuel gas compressor, it should be understood that the present invention is not limited to this example, it can be applied to an axial compressor which compresses some different gas to be compressed.

Moreover, although in the preferred embodiments of the device and method of the present invention detailed above the TOBI nozzles 52 were utilized to direct the bleed gas c in the same circumferential direction as the direction of rotation of the thrust balance disks 30, the present invention is not to be considered as being limited to the use of such TOBI nozzles, other structures could also be employed. That is, it would also be acceptable to process the nozzles directly upon the casing ring 40*b*.

The structure of the axial compressor described in the first aspect has a bleed gas flow conduit through which a portion of the gas to be compressed, after it has left the diffuser, is conducted to the thrust balance disk as bleed gas. According to this structure, the gas which has left the diffuser and is at a comparatively low temperature is supplied to the thrust balance disk as bleed gas, and therefore it is possible to cool the thrust balance disk efficiently, and it becomes possible to prevent deterioration of the mechanical strength of the thrust balance disk due to excessive heat increase because of the bleed gas.

Furthermore, with the axial compressor described in the second aspect, a structure is furthermore employed in which the bleed gas flows in a circumferential direction which is the same as the direction in which the thrust balance disk rotates. According to this structure, the temperature of the bleed gas which is experienced by the thrust balance disk is only its relatively low static temperature which is the result of subtracting the dynamic temperature from its total temperature, and accordingly it becomes possible to cool the thrust balance disk more effectively. Furthermore, it becomes possible to reduce the drive power which is required for driving the compression section, due to the impact force of the bleed gas in the same circumferential direction as the direction of rotation of the thrust balance disk, and therefore it becomes possible to perform recovery of drive power.

Furthermore, with the axial compressor described in the third aspect, a structure is furthermore employed in which the supply of bleed gas is performed via a TOBI nozzle. According to this structure, it becomes possible to supply the bleed gas so as accurately to follow the rotational movement of the thrust balance disk.

Furthermore, with the method for supplying bleed gas to a thrust balance disk of an axial compressor described in the fourth aspect, a method is utilized in which a portion of the gas to be compressed, after it has left the diffuser, is conducted to the thrust balance disk as bleed gas. According to this method, just as with the structure of the first aspect described above, it is possible to prevent deterioration of the mechanical strength of the thrust balance disk due to excessive heat increase because of the bleed gas.

Furthermore, with the method for supplying bleed gas to a thrust balance disk of an axial compressor described in the fifth aspect, a procedure is furthermore employed of flowing the bleed gas in a circumferential direction which is the same as the direction in which the thrust balance disk rotates. According to this method, in the same way as with the second aspect described above, it becomes possible to cool the thrust balance disk more effectively, and furthermore it becomes possible to perform recovery of drive power by reducing the drive power which is required for driving the compression section.

Furthermore, with the method for supplying bleed gas to a thrust balance disk of an axial compressor described in the sixth aspect, a procedure is furthermore employed of supplying the bleed gas via a TOBI nozzle. According to this method, in the same manner as with the third aspect described above, it becomes possible to supply the bleed gas so as accurately to follow the rotational movement of the thrust balance disk. It should be understood that, although the present invention has been shown and described in terms of certain preferred embodiments thereof, and with reference to the drawings, the various particular features of these embodiments and of the drawings are not to be considered as being limitative of the invention; variations and omissions to the details of any particular embodiment are possible, within the scope of the appended Claims.

What is claimed is:

1. An axial compressor, comprising a compression section which compresses gas to be compressed;

a diffuser which reduces the speed of said compressed gas from said compression section and subjects it to pressure recovery;

a thrust balance disk which receives a portion of said compressed gas as bleed gas after it has passed through said compression section, and which generates a counter thrust force which opposes thrust force which said thrust balance disk experiences as reaction force due to said compression section supplying said compressed gas under pressure; and a bleed gas flow conduit which conducts a portion of said compressed gas, after it has passed through said diffuser, to said thrust balance disk as said bleed gas.

2. An axial compressor according to claim 1, wherein said bleed gas is supplied to said thrust balance disk so as to flow in a circumferential direction which is the same as the direction in which said thrust balance disk rotates.

3. An axial compressor according to claim 2, wherein said bleed gas is supplied to said thrust balance disk via a TOBI nozzle.

4. A method for supplying bleed gas to a thrust balance disk of an axial compressor which comprises:

a compression section which compresses gas to be compressed;

a diffuser which reduces the speed of said compressed gas from said compression section and subjects it to pressure recovery; and said thrust balance disk which receives a portion of said compressed gas as bleed gas after it has passed through said compression section, and which generates a counter thrust force which opposes thrust force which said thrust balance disk experiences as reaction force due to said compression section supplying said compressed gas under pressure;

wherein a portion of said compressed gas, after it has passed through said diffuser, is conducted to said thrust balance disk.

5. A method for supplying bleed gas to a thrust balance disk of an axial compressor according to claim 4, wherein said bleed gas is supplied to said thrust balance disk so as to flow in a circumferential direction which is the same as the direction in which said thrust balance disk rotates.

6. A method for supplying bleed gas to a thrust balance disk of an axial compressor according to claim 5, wherein said bleed gas is supplied to said thrust balance disk via a TOBI nozzle.

* * * * *